United States Patent [19]

Ohtani et al.

[11] 4,269,358

[45] May 26, 1981

[54] BINARY FLUID BURNER DEVICE WITH BURNER UNITS COMBINED WHICH FUNCTIONS AS IF IT WERE A SINGLE LARGE-CAPACITY BURNER

[75] Inventors: Shigemori Ohtani; Shoji Tanno, both of Sendai, Japan

[73] Assignee: Kabushikikaisha Ohkawara Seisakusho, Yoshida, Japan

[21] Appl. No.: 61,381

[22] Filed: Jul. 27, 1979

[30] Foreign Application Priority Data

Aug. 22, 1978 [JP] Japan ..... 53-101443

[51] Int. Cl.[3] ..... B05B 7/06

[52] U.S. Cl. ..... 239/425; 239/430; 239/558; 239/567

[58] Field of Search ..... 239/417, 425, 424.5, 239/425.5, 429, 430–433, 556, 558–561, 567, 568

[56] References Cited

U.S. PATENT DOCUMENTS

| | | | |
|---|---|---|---|
| 747,312 | 12/1903 | Axtell | 239/417 |
| 1,657,995 | 1/1928 | Garneau | 239/433 |
| 2,511,755 | 6/1950 | Turpin et al. | 239/431 |
| 2,544,603 | 3/1951 | Lamar et al. | 239/425.5 |
| 2,610,676 | 9/1952 | Wheelock | 239/560 |
| 3,592,575 | 7/1971 | Jaeger | 239/558 |

FOREIGN PATENT DOCUMENTS

| | | | |
|---|---|---|---|
| 14935 | 2/1977 | Japan | 239/556 |

*Primary Examiner*—Andres Kashnikow
*Assistant Examiner*—Michael J. Forman
*Attorney, Agent, or Firm*—Stevens, Davis, Miller & Mosher

[57] ABSTRACT

This invention relates to a binary fluid burner device with burner units combined which functions as if it were a single large-capacity burner, in which small-capacity burner units are combined and mounted on a single burner head to form an integral burner device, and the flames from the burner units are integrated.

6 Claims, 7 Drawing Figures

BINARY FLUID BURNER DEVICE WITH BURNER UNITS COMBINED WHICH FUNCTIONS AS IF IT WERE A SINGLE LARGE-CAPACITY BURNER

BACKGROUND OF THE INVENTION

In the U.S. Pat. application Ser. No. 969,544, filed Dec. 14, 1978, as an invention related to the present invention, by Shigemori Otani, one of inventors of the present invention, "A burner for combustion apparatus" is disclosed.

The above-mentioned prior invention provides a so-called "Multistage pulverizing system" wherein as shown in FIG. 1*a*, an end is closed by a conical portion 2, an inclined surface 3 is provided with a number of fuel oil outflow ports 4 through which the fuel is jetted in a string-like manner, the fuel is broken up into atomized forms in the primary air passing through the orifice, and the fuel deposited on the inclined portions 3, 3' and 3'' is in the form of a film and is broken up in a film-like manner at apex side portions 2' and 2'' of the conical portion. That is, the prior invention relates to a burner in which even if pressure of the primary air for pulverization is low, the fuel can be extremely pulverized, that is, good atomization can be achieved. The use of the burner in accordance with the prior invention results in the quantity of fuel oil per hour, 200–300 l/hr, which means a considerable increase in the quantity of fuel oil at low pressure and under the conditions of good atomization as compared to conventional binary fluid atomizing burner, 10–20 l/hr, and binary fluid atomizing core burner (slit burner), 50–100 l/hr.

However, with the recent demand of larger type industrial furnaces and boilers, it has been required to further develop extremely large capacity binary fluid burners of more or less 1,000 l/hr in the quantity of fuel oil.

The present invention has been achieved to fulfill such a demand as noted above and provides a burner device which functions as if it were a single large-capacity burner wherein the characteristic of the burner disclosed in the above-mentioned prior U.S. Pat. application Ser. No. 969,544 is used so that the burner comprises burner units, which are plurally combined on the surface of a burner head.

The burner device in accordance with the present invention has the advantages as follows:

(a) The burner of the present invention is that a plurality of "A burner for combustion apparatus" as disclosed in the U.S. Pat. application Ser. No. 969,544 are combined as burner units to form a burner device which functions as if it were a single large-capacity burner. With this arrangement, good pulverization can be achieved with about 10% of the theoretical quantity of air for combustion, and good combustion performance may also be attained. As compared to prior arts in which only the desired number of independent burners are provided, the burner of the present invention is possible to control, adjust and manage the flames very easily since flames from burner units are in the form of a compound flame at first sight.

(b) Since an orifice for supplying only the primary air is disposed instead of inserting burner units into a central portion of the surface of the burner head, the deposition of oil drops on the surface of the bed board may be avoided, and accordingly, no scale-like carbon flour is deposited.

(c) The length and spread of the flame may be considerably adjusted by adjusting lateral movement of the burner units and orifices or by varying the angle of a frustum of the furnace head surface.

(d) It is possible to control generation of nitrogen oxide.

(e) In addition, also in precipitators of liquid pulverizing and atomizing type, spray dryers and humidifying apparatuses, it is possible to make the best use of characteristic of the present invention to anticipate effects similar to those mentioned above.

BRIEF SUMMARY OF THE INVENTION

The present invention relates to a binary fluid burner device with burner units combined wherein the burner units described in the aforementiond U.S. Pat. Application Ser. No. 969,544 are used, said burner units being inserted into a plurality of orifices in the surface of a burner head, the fuel is atomized and formed into a film by the primary air passing through said orifices thus burning the fuel in a pulverized manner, and an orifice through which only the primary air flows is disposed in a central portion of the surface of the bed board instead of inserting a burner unit therein. Thus, the burner device in accordance with the present invention functions as if it were a single large-capacity burner and can provide complete combustion without deposition of oil dripos on the burner assembly surface.

BRIEF DESCRIPTION OF THE SEVERAL VIEWS OF THE DRAWINGS

The present invention will be made more clearly by reference to the accompanying drawings in which:

FIG. 3*b* is a cross sectional view showing an essential part of FIG. 3*a.

DETAILED DESCRIPTION OF THE PREFERRED EMBODIMENTS

Figure 1A:
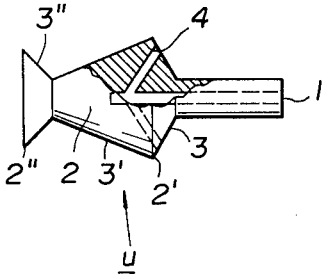
FIG. 1*a* is a partially cutaway front view of a burner unit.
Figure 1B:
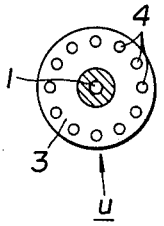
FIG. 1*b* is a side view showing the arrangement of fuel oil outflow passages.
Figure 2A:
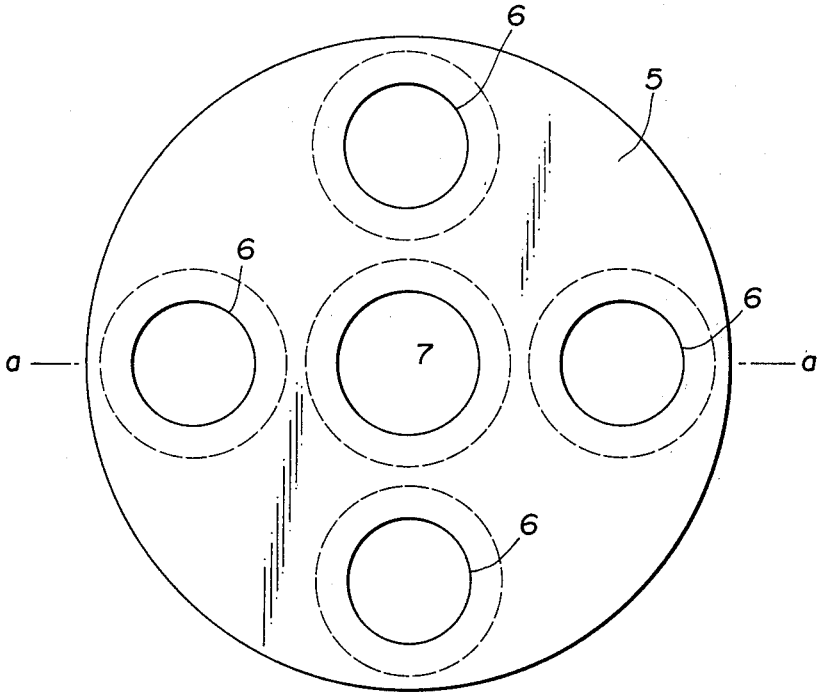
FIG. 2*a* is a plan view of a burner in accordance with a first embodiment of the present invention.

FIGS. 1 and 2 show the first embodiment in which a surface 5 of a burner head, on which burner units are mounted, is shown in plane.

In the drawings, the surface of the burner head 5 is in the form of a circular plane, in which an N number of orifices 6 (four in the illustrated embodiment) are disposed in a symmetrical manner, and burner units (FIG. 1*a*) are inserted into the orifices 6. A burner unit is not inserted into a center orifice 7 to which only the primary air is supplied. The reference numeral 12 designates a fuel tube for the supply of fuel to the burner units, and 13 a conduit for the primary air.

Figure 2B:
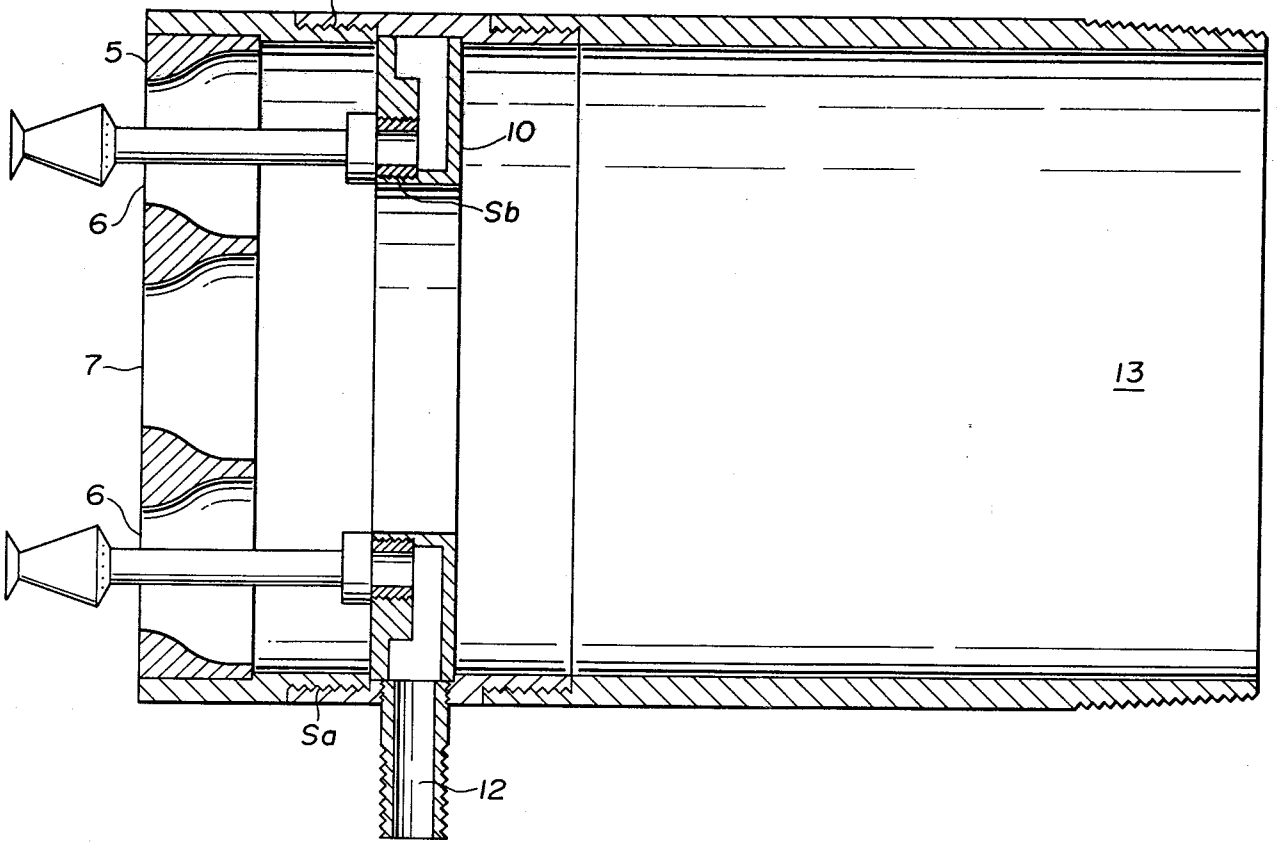
FIG. 2*b* is a sectional view taken on line a—a of FIG. 2*a;*

As shown in FIG. 2*b*, the burner units (u) and orifices (6, 7) may be adjusted laterally by means of threads (Sa, Sb) to thereby adjust the length of the flame.

The flames from the individual burner units is in the form of one and the same flame at first sight to produce required heat energy. Since the quantity of fuel oil per hour required for the burner units is larger than that of prior art burners, the burner of the present invention with a plurality of burners combined is possible to perform a function as a required extremely large capacity burner. As compared to conventional large boilers and industrial furnaces in which the desired number of independent burners need be disposed to compensate for short of capacity because a single burner is incorporated therein, it will be apparent that the burner of the present invention has a plurality of burner units combined to provide a function as a single burner so that operation and control are extremely easy.

The primary air jetted through the center orifice 7 serves to prevent an eddy flow of a mixture of air and liquid from the burner units.

That is, the test results of pulverization reveal that if the orifice 7 is not provided in the central portion, a phenomenon appears in which oil drops are deposited on the central portion of the surface of the burner head 5.

As described above, the burner of the present invention provides an arrangement wherein the orifice 7 is disposed to prevent the deposition of oil drops on the surface of the burner head 5.

In the burner of the present invention, cross sectional areas of the orifices 6 are varied to thereby prevent generation of nitrogen oxide to the utmost. It is known that the effective method of controlling nitrogen oxide is the double combustion method comprising air surplus combustion and air short combustion.

In the method of the present invention, for example, of four orifices as shown in FIG. 2, two orifices opposed to each other are larger than an area through which an optimum quantity of combustion air passes whereas another two orifices are smaller than an area through which an optimum quantity thereof passes, whereby air surplus combustion is effected on one hand while air short combustion is effected on the other hand to enable controlling generation of nitrogen oxide, thus anticipating combustion of good thermal efficiency as a whole.

Figure 3B:
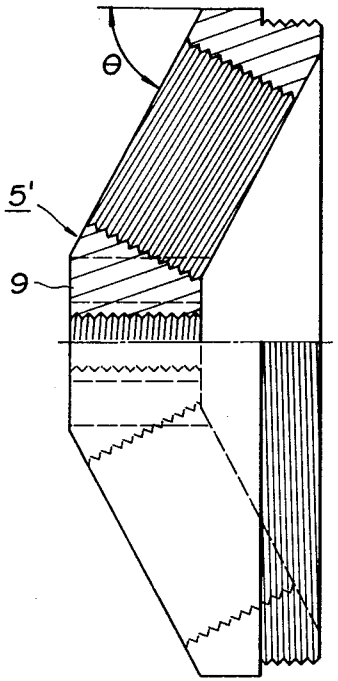
Figure 3A:
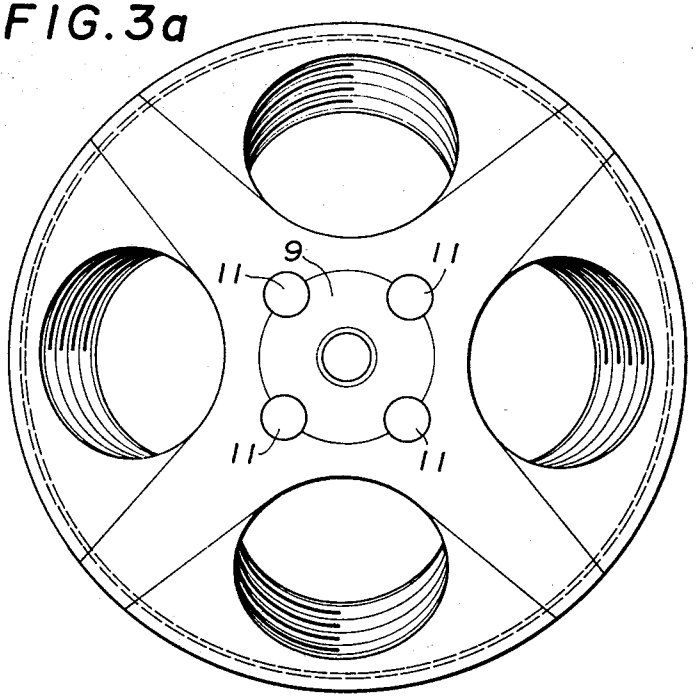
FIG. 3*a* is a plan view of a burner in accordance with a second embodiment of the present invention.
Figure 4:
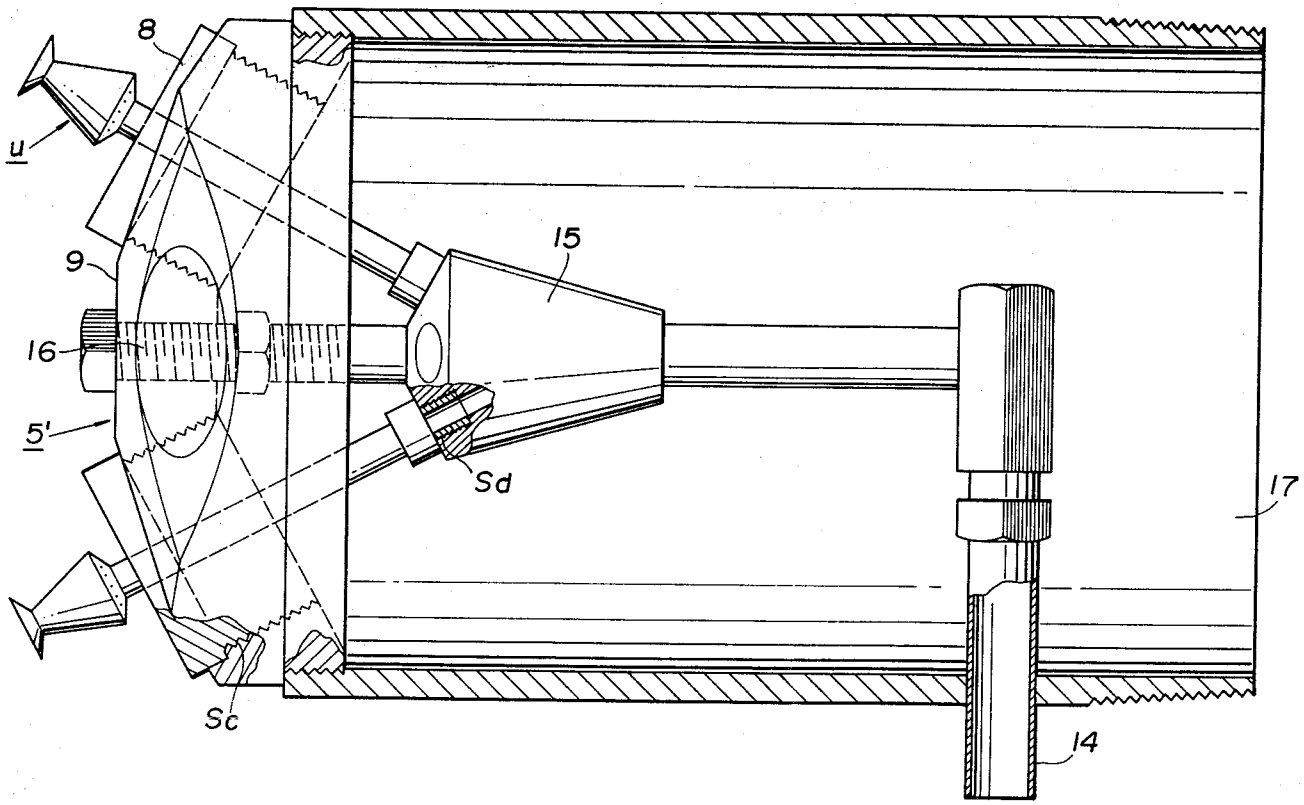
* and FIG. 4 is a front view of the same.

Next, the second embodiment in which the surface of the burner head is in the form of a frustum of cone will be explained with reference to FIGS. 3 and 4.

In this embodiment, since the surface of the burner head 5' is in the form of a frustum of cone unlike the first embodiment, orifices 8 for receiving burner units (u) are disposed in a conical inclined surface. Only the primary air flows from a N number of orifices (four in FIG. 3*a*) in the central portion. This eliminates an eddy flow of a mixture of air and liquid to prevent the deposition of oil drops on the surface of the burner head, in a manner similar to the first embodiment.

In the figures, the reference numeral 14 designates a fuel tube, 15 a distributor for fuel supplied to the respective burner unit, 16 means for supporting a device in a fuel supply system, and 17 a conduit for primary air.

Further, in this specific embodiment, the device may be manufactured by suitably varying an angle $\theta$ (60° in the figure) to thereby adjust the spreading angle of the flame.

Also, it is possible to control generation of nitrogen oxide in a manner similar to the case of the first embodiment.

In addition, the burner units (u) and orifices (8, 11) can be adjusted laterally to adjust the length of the flame.

What is claimed is:

1. A binary fluid burner comprising a burner head defining a plurality of symmetrically arranged orifices and at least one orifice positioned between the symmetrically arranged orifices through which only air passes and a nozzle smaller than said orifices and around which air passes positioned in each of said symmetrically arranged orifices, each said nozzle defining an axial fuel passageway disposed interiorly of said nozzle, a tip portion, a first frustoconical portion diverging in the downstream direction, a first conical portion converging in the downstream direction extending from the widest portion of the first frustoconical portion, said first frustoconical portion and said first conical portion blocking said tip portion, said first frustoconical portion diverging from said tip portion toward the extreme end of said nozzle and defining a plurality of fuel outflow passageways connected to said axial fuel passageway, said fuel outflow passageways being positioned to flow fuel backwardly from the fuel's forwardmost position in the axial fuel passageway until met by air passing over the diverging first frustoconical portion and a second frustoconical portion diverging in the downstream direction extending from the narrowest portion of said first conical portion converging in the downstream direction.

2. The fluid burner of claim 1 wherein said burner head is in the form of a plane.

3. The fluid burner of claim 1 wherein said burner head is in the form of a frustum of a cone and a plurality of passages carrying air only are disposed in the plane of the frustum.

4. The fluid burner of claim 3 including means to hold the nozzle at an angle with respect to the passages carrying air only.

5. The fluid burner of claim 1 including means to adjust relatively the nozzles and orifices to control the length of the flame.

6. The fluid burner of claim 1 wherein at least four symmetrically arranged orifices are present, two opposed orifices of which are of larger cross-sectional area than the cross-sectional area of the other two opposed orifices to effect air surplus combustion through the larger orifices and air short combustion through the smaller orifices.

* * * * *